US006002313A

United States Patent [19]

Mrenna et al.

[11] Patent Number: 6,002,313

[45] Date of Patent: Dec. 14, 1999

[54] MOLDED CASE CIRCUIT BREAKER WITH PRESSURE RELEASE MECHANISM

[75] Inventors: Stephen A. Mrenna, Beaver; Richard P. Malingowski, Finleyville; Kathryn M. Palmer, Sewickley, all of Pa.

[73] Assignee: Eaton Corporation, Cleveland, Ohio

[21] Appl. No.: 09/093,085

[22] Filed: Jun. 8, 1998

[51] Int. Cl.[6] ..... H01H 9/02

[52] U.S. Cl. ..... 335/202; 335/8; 335/35; 335/201; 200/306; 218/35; 218/155

[58] Field of Search ..... 335/202, 201, 335/8, 9, 10, 35; 200/306; 218/35, 155, 156

[56] References Cited

U.S. PATENT DOCUMENTS

| | | | |
|---|---|---|---|
| 4,503,408 | 3/1985 | Mrenna et al. | 335/35 |
| 4,581,511 | 4/1986 | Leone | 200/306 |
| 4,639,564 | 1/1987 | Grunert et al. | 200/144 |
| 4,650,940 | 3/1987 | Grunert et al. | 200/144 R |
| 5,015,983 | 5/1991 | DeRosier et al. | 336/180 |

*Primary Examiner*—Michael L. Gellner
*Assistant Examiner*—Tuyen T. Nguyen
*Attorney, Agent, or Firm*—Martin J. Moran

[57] ABSTRACT

A circuit interrupter including an operating mechanism and separable main contacts interconnected with load and line terminals has an interface region between the top and bottom portions of the completed housing thereof, which may be of reduced cross section relative to the remainder of the side walls of the circuit interrupter for being moved or pushed outwardly under the pressure of expanding gas during a circuit interruption operation. To more easily clear or separate abutment surfaces by near lateral movement thereof to provide a small opening for pressurized gas to escape the elasticity of the side wall is utilized for this purpose. Provided that the elasticity limit is not exceeded, the wall will return to its original position sealing the internal portions of the circuit interrupter from the exterior once the gas pressure has dropped below a predetermined level.

21 Claims, 5 Drawing Sheets

MOLDED CASE CIRCUIT BREAKER WITH PRESSURE RELEASE MECHANISM

CROSS REFERENCE RELATED APPLICATIONS

This case is related to patent application Ser. No. 08/864,104 (Docket No. 96-PDC-547) entitled "Circuit Interrupter With Covered Accessory Case, Adjustable Under Voltage Relay, Self-Retaining Collar And One-Piece Rail Attachment" filed on May 28, 1997 by Richard P. Malingowski et al.

BACKGROUND OF THE INVENTION

1. Field of the Invention

The subject matter of this invention is related to molded case circuit breakers in general and in particular to mechanisms for relieving gas pressure built up within molded case circuit breakers during the contact opening operation.

2. Description of the Prior Art

Molded case circuit breakers are well known. A sample of a molded case circuit breaker may be found in U.S. Pat. 4,503,408 issued Mar. 5, 1985 to Mrenna et al., and assigned to the present assignee. In particular, a molded case circuit breaker generally comprises a two-piece molded casing. There is a top and a bottom part, inside of which is disposed an operating mechanism and separable main contacts.

Generally, the top and bottom portion of the case are either securely butt joined or joined with a locking mechanism, so as to secure the case and to prevent interference with or contact with operating mechanisms, live portions and separable main contacts disposed within the closed casing. A disadvantage, however, is associated with this construction feature, in that gas is generated within the confines of the circuit breaker case during a circuit breaker interruption operation. This gas is usually the result of the electrical arc which is drawn during the contact separation interval which interacts with the molded case material or other material within the circuit breaker. The gas generated must be vented to an external environment. Usually vent apparatus are provided at the rear or load terminal region of the circuit interrupter to achieve this purpose. Such an arrangement can be found in U.S. Pat. No. 4,639,564, entitled "Circuit Breaker with Arc Chamber Vent": issued Jan. 27, 1987 to Grunert et al., and assigned to the present assignee. As can be understood, the maximum current interrupting capability of the circuit breaker is limited by its ability to exhaust undesirable gaseous products. The amount of current which can be safely interrupted is directly related to the heat and size of the electrical arc, which in turned is related to the amount of gas generated. If the gas generation is so high as to exceed the capability of exhausting it, the case itself could be impaired, such as, by destruction, etc. However, in most prior art applications the case is made stronger and larger than it is otherwise necessary to interrupt the expected current in an overload condition to compensate for this.

However, if a way could be found to increase the interrupting capability of the circuit interrupter by providing a alternate or emergency gas exit function, such function would be desirable as the size and/or strength of the case could be reduced.

SUMMARY OF THE INVENTION

In accordance with the invention a circuit interrupter is provided which includes a housing top portion and housing bottom portion joined at a normally closed interface region to form a completed circuit interrupter case. The bottom portion has an internal taper adjacent to the normally closed interface region, forming a region of reduced thickness. The circuit interrupter has an operating mechanism disposed within the case for operating the separable main contacts. The separable main contacts, when opened, strike an arc which generates gas, which must be exhausted from the aforementioned case. When that happens the aforementioned interface region is elastically deformed as a result of the gas obtaining a predetermined pressure to open a portion of the interface region to allow the gas under pressure to escape to the region outside of the enclosed circuit interrupter case. The interface region then elastically returns to its closed disposition as the pressure of the gas within the enclosed circuit interrupter case is reduced The taper acts to channel the gas to the interface region and to provide a relatively thinner area of abutment with the upper case portion, so that a small amount of deformation of the bottom case portion will lead to gas exhaustion. Nevertheless, the overall strength of the bottom case portion is not substantially reduced because of the relatively small area of the interface taper.

BRIEF DESCRIPTION OF THE DRAWINGS

In accordance with the invention reference may be had to the preferred embodiment thereof shown in the accompanying drawings in which.

DESCRIPTION OF THE PREFERRED EMBODIMENT

Figure 1:
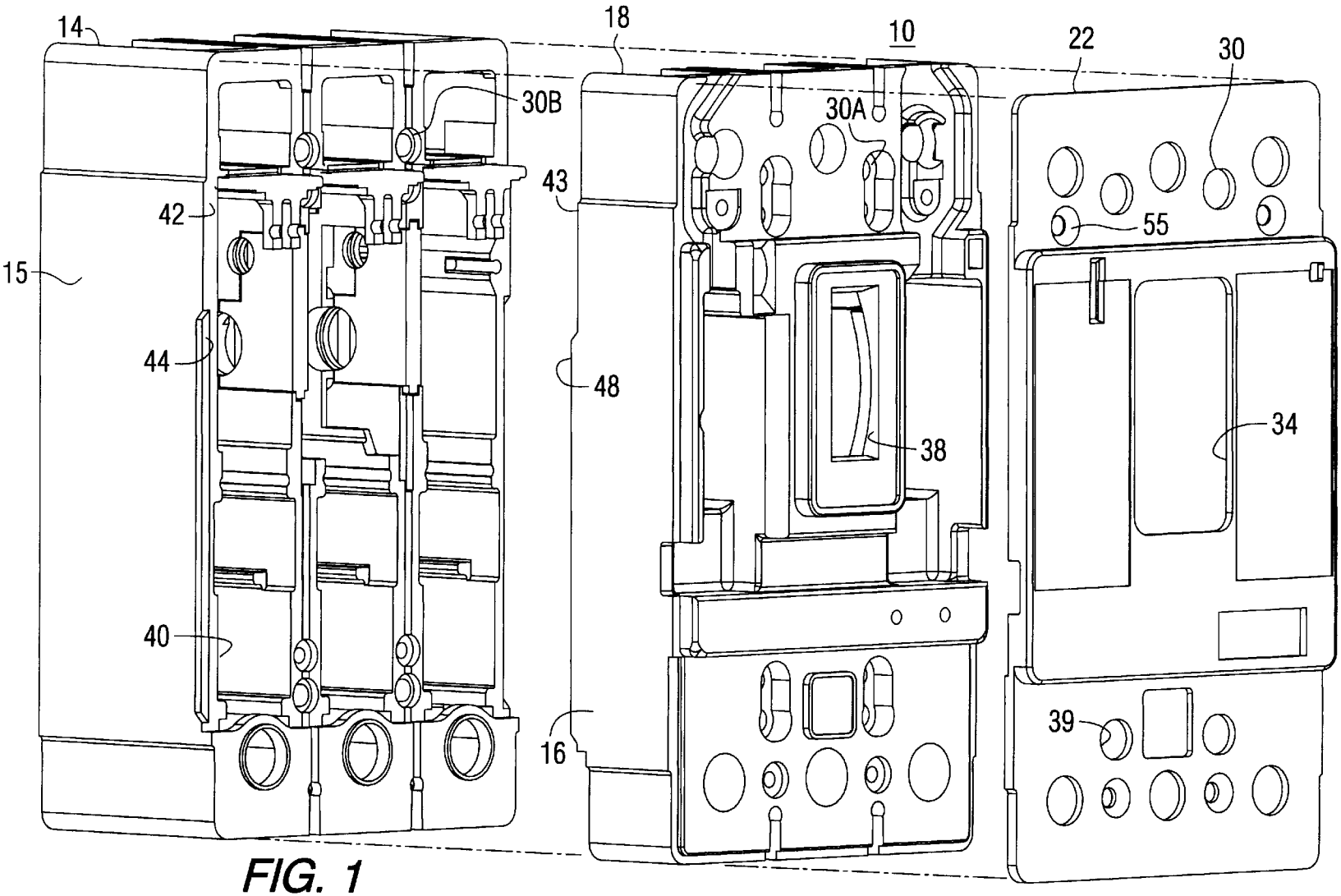
FIG. 1 PRIOR ART
FIG. 1 depicts an orthogonal, exploded view of a prior art molded case breaker having a bottom portion, a top portion and a cover.

Referring now to the drawings and FIG. 1, in particular, there is shown an exploded view of a prior art circuit breaker case 10. In particular the case 10 includes a bottom portion 14, a top portion 18 and an auxiliary cover 22. The bottom portion 14 has a lateral, side or bottom portion wall 15, and the top portion 18 has a lateral, side or top portion wall 16. It is to be understood with respect of all the embodiments taught herein, that the sides 15 and 16 may be the reversed from those viewed in the drawings. That is, the sides 15 and 16 may be on opposite sides of the circuit breaker from the sides depicted. Also shown are aligned screw holes 30, 30A and 30B in the auxiliary cover 22, top portion 18 and bottom portion 14 respectfully for joining all three portions. Also shown are aligned openings 34 and 38 for communication with the internal portion of the circuit breaker for clearance for an operating mechanism handle to protrude therethrough. Shown on the sides 15 and 16 respectfully, are a bottom portion transverse butt surface 42 and a top portion transverse butt surface 43.

Figure 4:
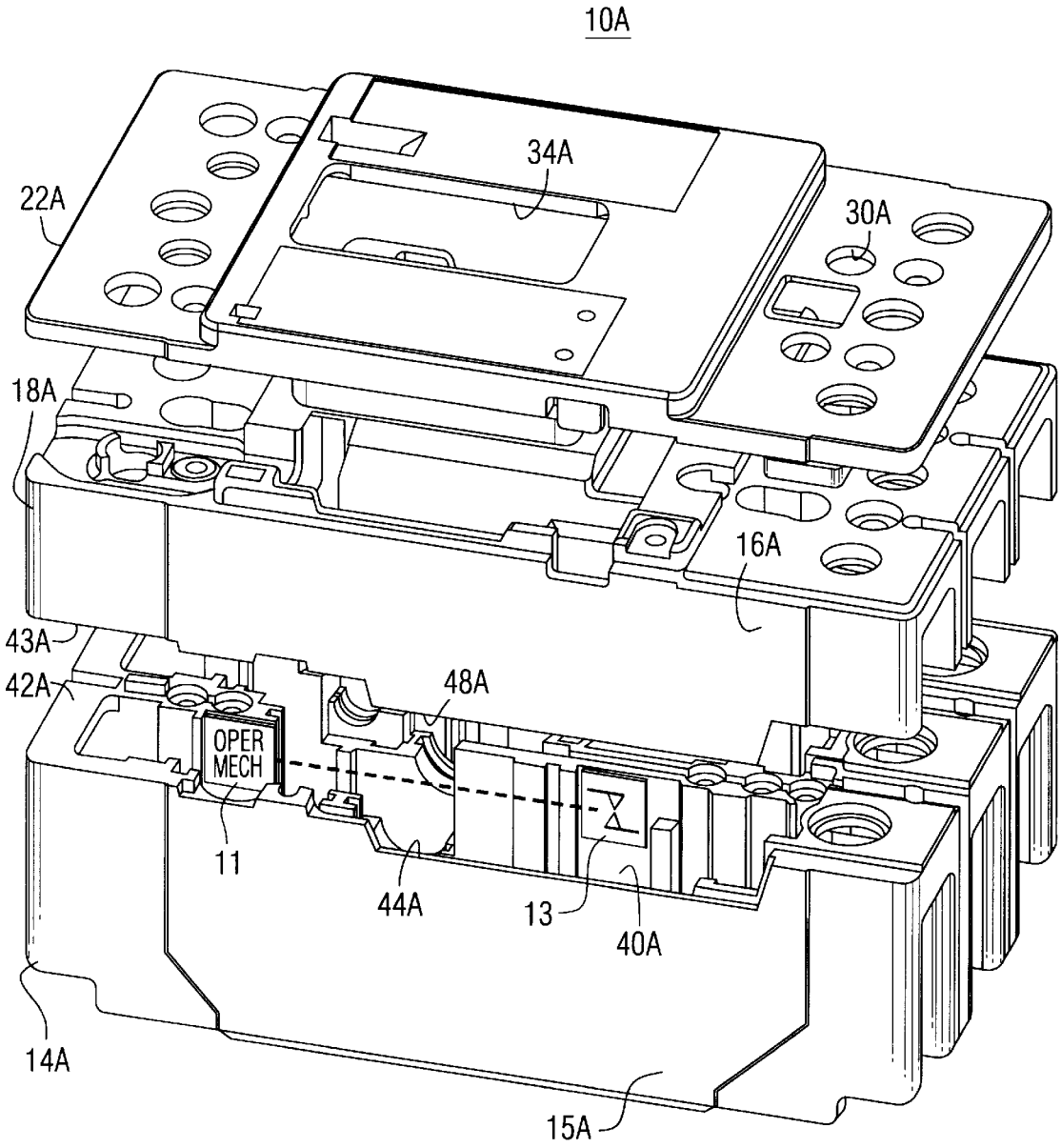
FIG. 4 shows a representation similar to FIG. 1 but for an embodiment of the present invention.

An operating mechanism 11 and separable main contacts 13 or electrical interconnections are shown schematically in FIG. 4. Details of such arrangement can be found in incorporated-by-reference U.S. Pat. No. 4,503,408.

Figure 2:
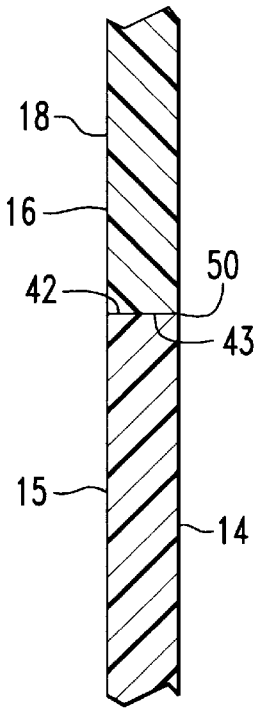
FIG. 2 shows a prior art sectional representation of a broken away side wall of the circuit interrupter of the FIG. 1 in a non-deformed configuration.

Referring now to FIG. 2 a prior art representation of a part of the abutted top portion 18 and bottom portion 14 is shown. In particular the arrangement of the top portion side wall 16 relative to the bottom portion side wall 15 is depicted. It can be seen that bottom portion butt surface 42 evenly abuts the top portion butt surface 43 forming an interface region 50.

Figure 3:
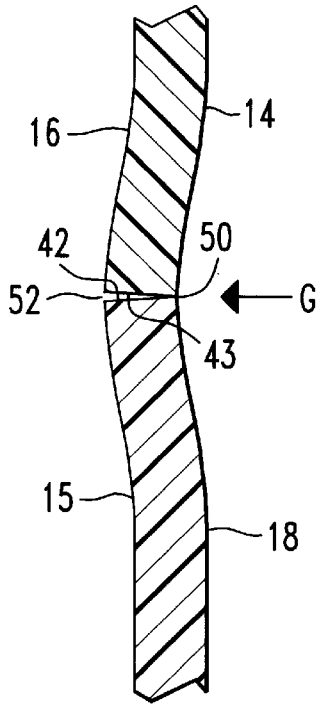
FIG. 3 shows an arrangement similar to FIG. 1 but where the side wall is temporary deformed at the interface region, due to the pressure of gas build up within the circuit breaker.

Referring now to FIG. 3, the arrangement shown with respect to FIG. 2 is depicted once again, but with the effect of a generated gas G exerting pressure against the side walls 15 and 16. In particular, the external part of the bottom portion butt surface 42 and top portion butt surface 43, are separated slightly as the result of the bulge that is created outwardly or to the left by the pressure of the gas G. In this arrangement, the interface region 50 is not completely opened, as it is desired that gap 52 be minimized so as to prevent the gas G from escaping. In the prior art, the foregoing was a desirable feature as it maintained the structural integrity of the circuit breaker case, prevented exterior atmospheric elements from bleeding back into the circuit breaker case and prevented gaseous products from bleeding outwardly of the circuit breaker case.

Referring now to FIG. 4 an exploded view of the circuit breaker case embodying the teachings of the present invention is depicted. In this embodiment of the invention like or similar parts are represented by like or similar reference symbols, except with the addition of the designation A to indicate that these parts are associated with the present embodiment of the invention and not with the prior art arrangement. In particular, there are provided: a bottom portion 14A, a top portion 18A, a cover 22A and sides 16A and 15A. Sides 16A and 15A end in abutting surfaces 43A and 42A respectively similar to that shown with respect to FIG. 1. The circuit interrupter 10A includes holes or openings, 30A for example, for joining the exploded portions 14A, 18A and 22A together. The handle opening 34A is depicted in the protective cover 22A. There is also shown an interruption chamber 40A.

Figure 5:
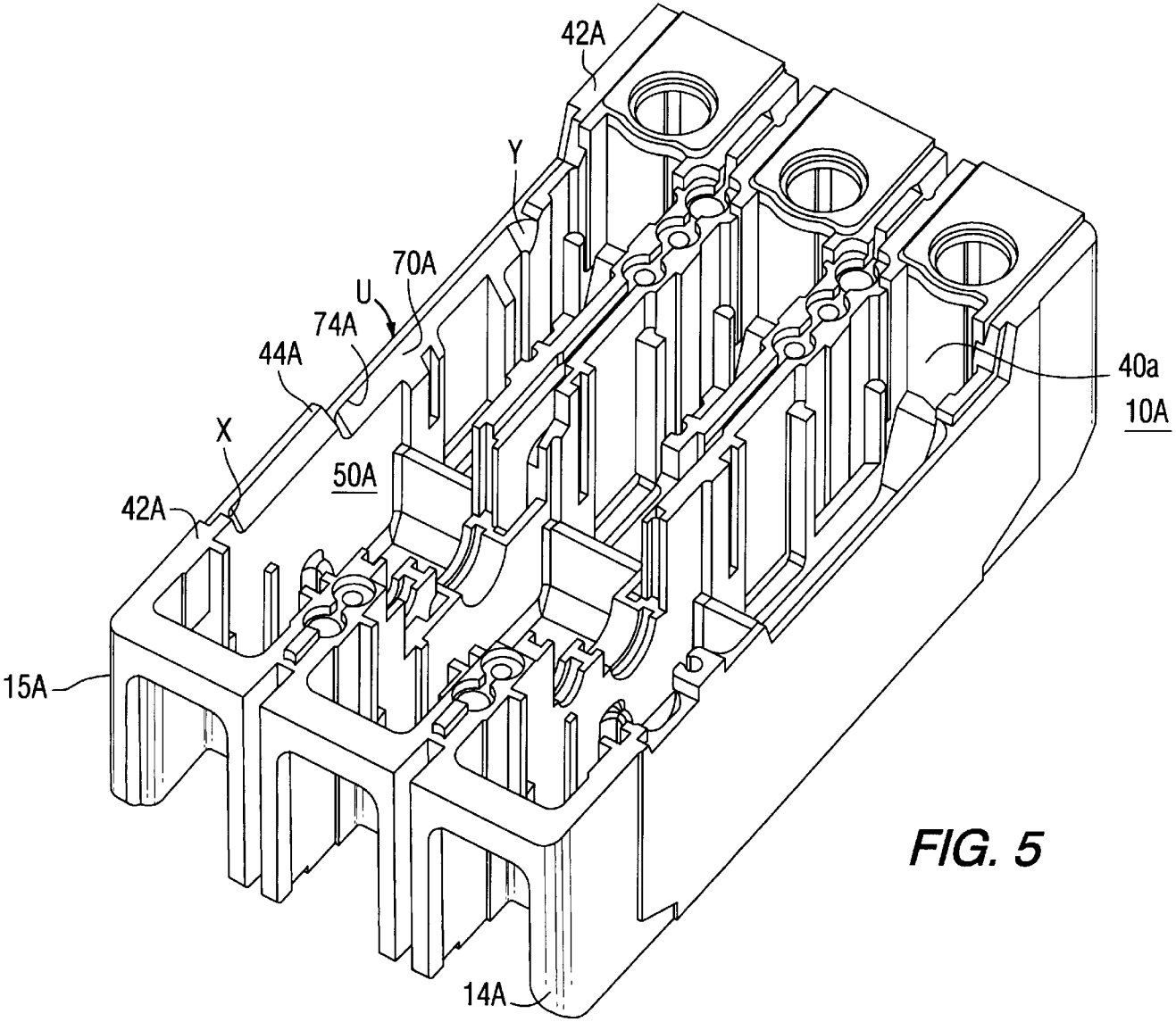
FIG. 5 shows a portion of the arrangement of FIG. 4 with the top portion and cover removed and with the bottom portion rotated from the disposition in FIG. 1 to show the taper arrangement at the interface region.

Referring now to FIG. 5, the bottom portion 14A is depicted in another orientation for purposes of simplicity of illustration. In particular the side 15A is shown to the left in FIG. 5 with the aforementioned butting surface 42A depicted. The interruption chamber 40A for the circuit breaker 10A is also depicted. In this situation, the interface region 50A is depicted as a region of reduced cross section, such as indicated at 44A. This region of reduced cross section is formed from taper 70A on the side wall 15A. The side wall 15A in the region 50A of the abutment surface 42A is reduced to the thickness between the points 74A and U as the result of presence of the taper surface 70A.

Figure 6:
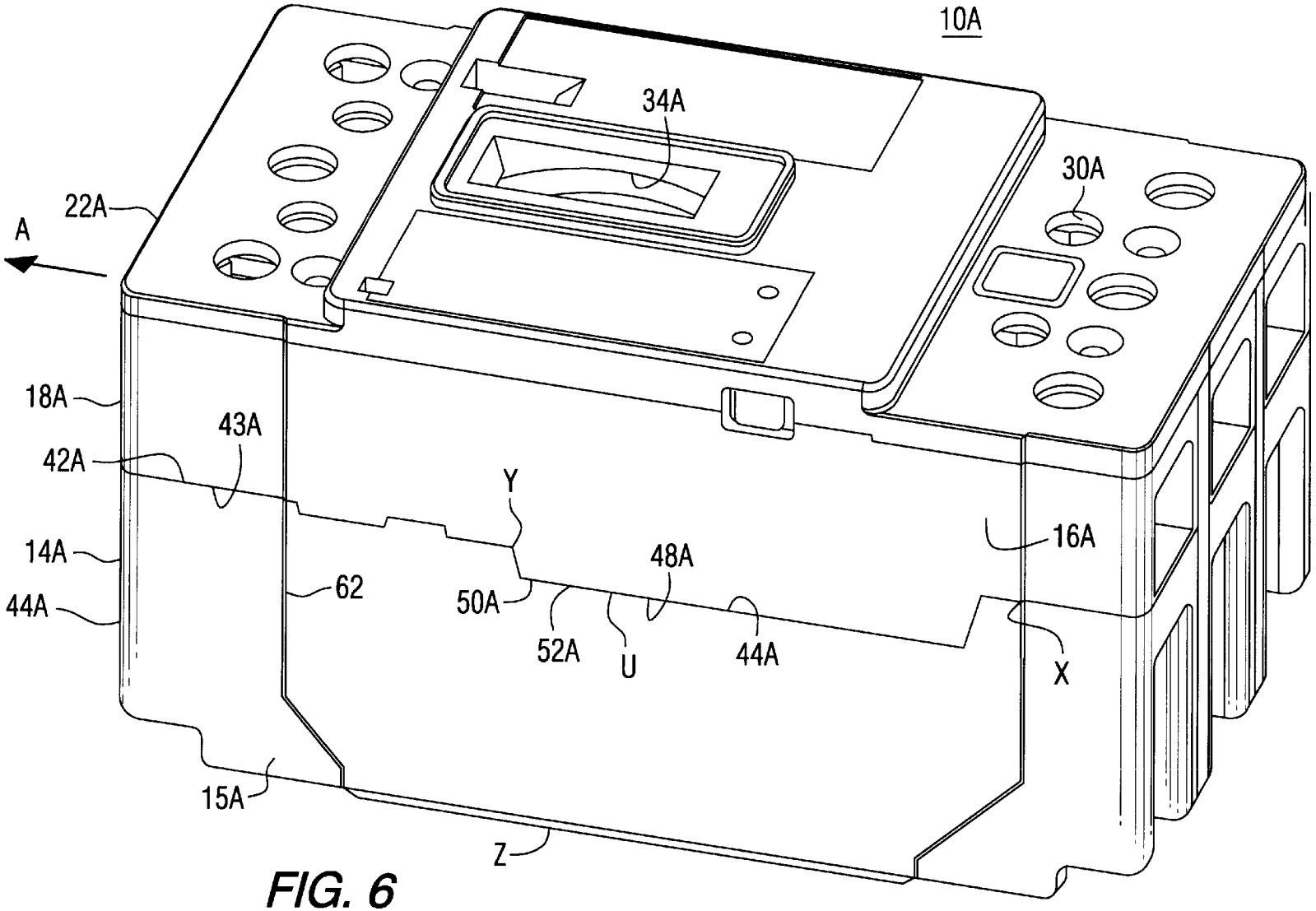
FIG. 6 shows the arrangement similar to FIG. 4 but with the top and bottom portions joined together to form an enclosed circuit interrupter case.

Referring now to FIG. 6 a depiction of the individual elements 14A, 18A and 22A of FIGS. 4 and 5 is shown in the completed or enclosed circuit breaker housing disposition. In particular, the arrangements of the reference points X, Y, Z and U are depicted. These points are important because they are useful for illustrating the action of a circuit breaker apparatus in operation. For purposes of the present embodiment, it is to be understood that although no circuit interrupter internal parts are shown, that those parts are incorporated by reference from U.S. Pat. No. 4,503,408. Consequently, operating mechanisms, separable main contacts and electrical interconnection parts are present in the circuit breaker case, so that an entire circuit breaker 10A is described with respect to the present invention. During a circuit interrupter operation, as the separable main contacts open, gaseous sub-products are exhausted, normally in the direction A. However, in this embodiment of the invention, if excessive gas pressure builds up within the enclosed housing of the circuit interrupter 10A, the side walls may bulge out horizontally between the regions X and Y and vertically between the regions Z and U. The region U expands outwardly more dramatically than the regions X, Y and Z.

Figure 7:
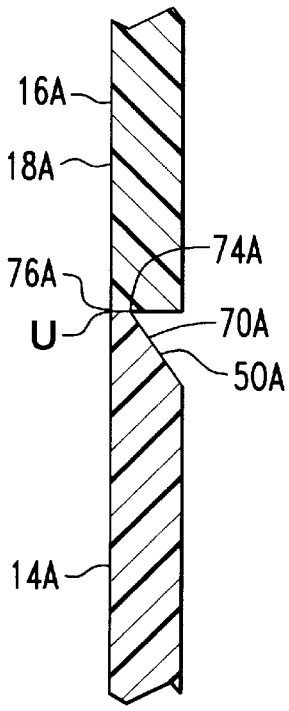
FIG. 7 shows an arrangement similar to the prior art arrangement of FIG. 2 but depicting the teachings of the present invention.
Figure 8:
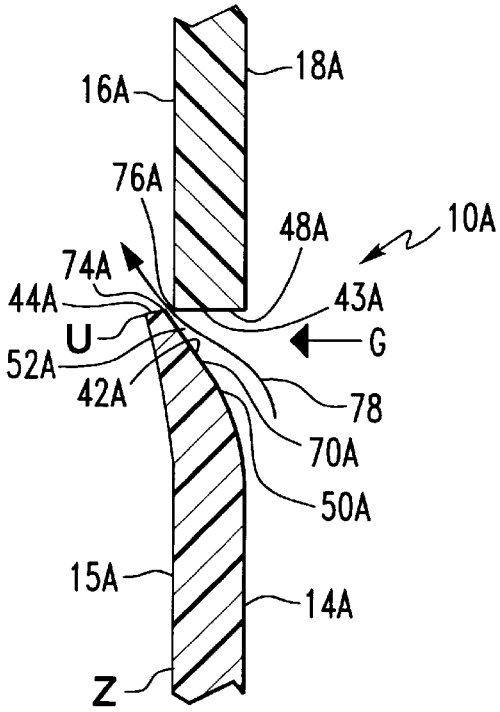
FIG. 8 shows an arrangement similar to the prior art arrangement of FIG. 3 but depicting the gas reduction activity of the present invention.

Referring now to FIGS. 7 and 8, a clear understanding of the present invention may be had. FIG. 7 shows a broken away side elevation, similar to that of FIG. 2 of the prior art, in which the region of reduced cross section 50A formed by the taper 70A is depicted. It is to be noted that the portion between edges U and 74A overlap point 76A on the side wall 16A of the top portion 18 forming a region of abutment, similar to that shown in the prior art of FIG. 2, but covering a much smaller lateral region as depicted by the end points U and 74A.

Referring now to FIG. 8 in particular, as the gas pressure G is applied, wall 14A may expand or dome out to the left. The more pronounced action between the points Z and U caused by the gas pressure G, causes the point 74A to clear the point 76A to interrupt the abutment between the bottom portion, butt surface 42A and upper portion butt surface, 43A in the regions 44A and 48A. This allows the gas G to escape along the path 78 to reduce the internal gas pressure sufficiently to allow the elasticity of the wall 14A, which had been moved to the left under the pressure of the gas G to return to the right thus joining the abutment surfaces 44A and 48A once again thus interrupting the gas flow 78.

It is to be understood with respect to the embodiments of the invention, the that gas pressure reduction concept is not limited to the specific embodiment depicted. Furthermore the area of reduced cross section need not necessarily be formed by taper.

What we claim as our invention is:

1. A circuit interrupter, comprising:

first housing means;

a second housing means joined at a normally closed elastically deformable interface region with said first housing means for forming a completed circuit interrupter housing means;

circuit interrupter operating means disposed within said completed circuit interrupter housing means;

separable contact means disposed within said completed circuit interrupter housing means and operable by said operating means, gas being generated within said completed circuit interrupter housing means as a result of said separable contact means moving toward an open disposition, wherein said gas attains a predetermined pressure within said completed circuit interrupter housing means;

said elastically deformable interface region being elastically deformed as a result of said predetermined pressure of said gas to open a portion of said elastically deformable interface region to allow said gas under pressure to escape to a region outside of said completed circuit interrupter housing means; and said elastically deformable interface region elastically returning to said closed disposition as the pressure of said gas within said completed circuit interrupter housing means is reduced.

2. The combination as claimed in claim 1, wherein said first housing means comprises a top portion for said completed circuit interrupter housing means and said second housing means comprises a bottom portion for said completed circuit interrupter housing means.

3. The combination as claimed in claim 2, wherein one of said fist housing means and said second housing means has as said elastically deformable interface region a region of reduced thickness for being elastically deformed to open a portion of said elastically deformable interface region to allow said gas under pressure to escape to said region outside of said completed circuit interrupter housing means.

4. The combination as claimed in claim 3, wherein said reduced thickness allows said elastically deformed region to be freed from the other of said first housing means and said second housing means to open said portion of said elastically deformable interface region more easily than if said region of reduced thickness were not present.

5. The combination as claimed in claim 3, wherein said reduced thickness allows said elastically deformed region to be freed from the other of said first housing means and said second housing means to open as a result of said gas attaining said predetermined pressure, whereas said elastically deformed region would not be freed from said other of said first housing means and said second housing means as a result of said gas attaining said predetermined pressure if said region of reduced thickness were not present.

6. The combination as claimed in claim 2, wherein both of said first housing means and said second housing means have a region of reduced thickness adjacent said elastically deformable interface region for being elastically deformed to open a portion of said elastically deformable interface region to allow said gas under pressure to escape to said region outside of said completed circuit interrupter housing means.

7. The combination as claimed in claim 3, wherein said first housing means comprises a top portion for said completed circuit interrupter housing means and said second housing means comprises a bottom portion for said completed circuit interrupter housing means; and wherein said bottom portion has said region of reduced thickness.

8. The combination as claimed in claim 3, wherein said first housing means comprises a top portion for said completed circuit interrupter housing means and said second housing means comprises a bottom portion for said completed circuit interrupter housing means; and wherein said top portion has said region of reduced thickness.

9. The combination as claimed in claim 3, wherein said regions of reduced thickness comprise a taper.

10. The combination as claimed in claim 7, wherein said region of reduced thickness comprises a taper.

11. The combination as claimed in claim 8, wherein said region of reduced thickness comprises a taper.

12. The combination as claimed in claim 3, wherein said region of reduced thickness assists in channeling said gas to said interface region.

13. The combination as claimed in claim 7, wherein said region of reduced thickness assists in channeling said gas to said interface region.

14. The combination as claimed in claim 8, wherein said region of reduced thickness assists in channeling said gas to said elastically deformable interface region.

15. The combination as claimed in claim 12, wherein said regions of reduced thickness comprise a taper.

16. The combination as claimed in claim 13, wherein said region of reduced thickness comprises a taper.

17. The combination as claimed in claim 14, wherein said region of reduced thickness comprises a taper.

18. A circuit interrupter, comprising a housing top portion;

a housing bottom portion joined at a normally closed elastically deformable interface region with said housing top portion for forming a completed circuit interrupter case;

said bottom portion having a taper adjacent said normally closed elastically deformable interface region forming a region of reduced thickness;

circuit interrupter operating means disposed within said completed circuit interrupter case;

separable main contact means disposed within said completed circuit interrupter case and operable by said operating means to open said main contacts, gas being generated within said completed circuit interrupter case as said main contacts are opened, wherein said gas attains a predetermined pressure within said completed circuit interrupter case;

said elastically deformable interface region being elastically deformed at said elastically deformable interface region as a result of said predetermined pressure of said gas to open a portion of said elastically deformable interface region to allow said gas under pressure to escape to a region outside of said completed circuit interrupter case; and said elastically deformable interface region elastically returning to said closed disposition as the pressure of said gas within said completed circuit interrupter case is reduced.

19. The combination as claimed in claim 18, wherein said taper assists in channeling said gas to said elastically deformable interface region.

20. The combination as claimed in claim 18, Wherein said taper allows said elastically deformed region to be freed from said housing top portion more easily than if said region of reduced thickness were not present.

21. The combination as claimed in claim 18, wherein said taper allows said elastically deformed region to be freed from said housing top portion to open as a result of said gas attaining said predetermined pressure, whereas said elastically deformed region would not be freed from said housing top portion as a result of said gas attaining said predetermined pressure if said region of reduced thickness were not present.

* * * * *